US008628324B2

(12) United States Patent
Burnett et al.

(10) Patent No.: US 8,628,324 B2
(45) Date of Patent: Jan. 14, 2014

(54) SINGLE BURNER SNOW MELTER CAPABLE OF A SNOW START OPERATION

(75) Inventors: David Burnett, Boutillers Point (CA); Glen Burnett, Halifax (CA); Steven Meredith, Stillwater Lake (CA)

(73) Assignee: Trecan Combustion Ltd, Nova Scotia (CA)

( * ) Notice: Subject to any disclaimer, the term of this patent is extended or adjusted under 35 U.S.C. 154(b) by 1247 days.

(21) Appl. No.: 12/485,210

(22) Filed: Jun. 16, 2009

(65) Prior Publication Data

US 2010/0196835 A1 Aug. 5, 2010

(51) Int. Cl.
*E01C 19/45* (2006.01)

(52) U.S. Cl.
USPC ..... 432/1; 126/343.5 R; 126/160; 37/227; 37/228; 431/160

(58) Field of Classification Search
USPC ..... 432/1; 37/197, 228; 126/343.5 R, 160; 431/160
See application file for complete search history.

(56) References Cited

U.S. PATENT DOCUMENTS

| | | | | |
|---|---|---|---|---|
| 3,304,632 | A | 2/1967 | Kolar et al. | |
| 4,164,820 | A | 8/1979 | Krickovich | |
| 4,353,176 | A | 10/1982 | Hess | |
| 5,235,762 | A | 8/1993 | Brady | |
| 5,266,220 | A | 11/1993 | Hammond et al. | |
| 5,615,666 | A | 4/1997 | Ransom | |
| 5,615,668 | A | 4/1997 | Panz et al. | |
| 5,791,335 | A | 8/1998 | Luciani | |
| 6,238,207 | B1 | 5/2001 | Sarkinen | |
| 6,293,277 | B1 | 9/2001 | Panz et al. | |
| 6,305,105 | B1 | 10/2001 | Lowman | |
| 6,360,738 | B1 * | 3/2002 | Brooks | 126/343.5 R |
| 6,736,129 | B1 | 5/2004 | Smith | |
| 7,455,060 | B2 | 11/2008 | Burnett et al. | |
| 7,845,314 | B2 * | 12/2010 | Smith | 122/379 |
| 2004/0074114 | A1 * | 4/2004 | Rogers | 37/228 |
| 2006/0137677 | A1 * | 6/2006 | Burnett et al. | 126/343.5 R |
| 2006/0272182 | A1 | 12/2006 | Gertner | |
| 2008/0178866 | A1 | 7/2008 | Davies | |
| 2008/0276498 | A1 * | 11/2008 | Soderberg et al. | 37/197 |
| 2009/0227826 | A1 * | 9/2009 | Rost et al. | 588/320 |
| 2011/0303367 | A1 * | 12/2011 | Panz et al. | 159/16.2 |
| 2011/0303368 | A1 * | 12/2011 | Panz et al. | 159/16.2 |

FOREIGN PATENT DOCUMENTS

| | | |
|---|---|---|
| CA | 712840 | 7/1965 |
| CA | 741959 | 9/1966 |

(Continued)

*Primary Examiner* — Steven B McAllister
*Assistant Examiner* — Nikhil Mashruwala
(74) *Attorney, Agent, or Firm* — McDermott Will & Emery LLP

(57) ABSTRACT

A single burner snow melter is capable of a snow start. The burner assembly has a fuel burner having adjustable combustion output and a nozzle through which products of combustion emerge, and a combustion chamber which has a first portion in substantially air-tight communication with the fuel burner and which encloses the nozzle. A second portion of the combustion chamber is shaped and dimensioned such that the second portion is placed into a snow melting receptacle or pit. The combustion chamber has a plurality of directional discharge means formed at least on its second portion through which products of combustion from the fuel burner emerge, and thus agitate, and melt snow loaded into a tank or pit. The burner assembly also includes an air cooling assembly for supplying air to cool at least the first portion of the combustion chamber.

13 Claims, 4 Drawing Sheets

(56) References Cited

FOREIGN PATENT DOCUMENTS

| | | |
|---|---|---|
| CA | 769461 | 10/1967 |
| CA | 825952 | 10/1969 |
| CA | 907989 | 8/1972 |
| CA | 2450796 | 12/2003 |
| CA | 2491322 | 12/2004 |
| SU | 1418385 | 8/1988 |

* cited by examiner

SINGLE BURNER SNOW MELTER CAPABLE OF A SNOW START OPERATION

RELATED APPLICATION

This application claims priority to Canadian Patent Application Number 2,651,636, filed Feb. 5, 2009, the entire contents of which are incorporated herein by reference.

FIELD OF THE INVENTION

The present invention relates to snow melting equipment, and more specifically, to improvements in traditional snow melters which utilize heat to melt and thus dispose of large amounts of snow. In particular, the invention relates to a single burner snow melting apparatus capable of a snow start operation.

BACKGROUND OF THE INVENTION

Snow melting devices known in the art commonly utilize a burner unit or assembly to provide heat to a snow melting medium, typically water. The heated medium is then used in various ways to melt the snow.

Canadian Patent No. 780,673 and U.S. Pat. No. 3,187,743 (both to Primas) disclose a snow melting device commonly known in the art. This device includes a tank and a fuel burner assembly. The burner assembly includes a downwardly extending downcomer tube which encloses the fuel burner nozzle. The downcomer tube is provided with an opening at the bottom for the outflow of combustion gases from the sides, and a closure plate disposed over the end thereof at a slight distance therefrom. A tubular housing, or weir, is provided around the downcomer tube with a bottom opening, and with an upper opening at a location above the lower end of the downcomer tube for the outflow of combustion gases and hot water. The burner assembly is positioned inside the tank, into which snow is introduced for melting. In operation, water is supplied to a specified height in the tank, the burner is ignited, and combustion gases are discharged downwardly from the burner nozzle through the downcomer tube and out through the bottom openings beneath the water surface. The combustion gases, on exiting the "slots" (20), break down into millions of minute bubbles as they contact the water present in the annular space. The instantaneous mixing and transfer of heat to the water causes an immediate decrease in bulk density of the mixture causing the mixture to rise vertically up the annular space inside the weir and violent discharge thereof out of the opening at the top of the weir. A deflector plate positioned at the top opening directs the heated water laterally onto the snow in the tank. The heated water strikes the upper surface of the snow in the tank and melts it. The tank disclosed by Primas is designed to maintain a body of water as a melting source and for cooling of the burner assembly.

U.S. Pat. No. 6,736,129 (Smith) discloses another example of a snow melting apparatus in which a container, or tank is provided with a burner having a modified combustion chamber. At least a portion of the combustion chamber is submerged in the snow melting medium, ie. water. The submerged portion of the combustion chamber includes a horizontally extending sparger tube through which combustion gases emerge. The combustion gases cause nucleate boiling and strong agitation from below the water level, and thereby accelerate the melting process. The disclosed snow melting apparatus also includes a mechanism for removing debris from the snow, and a control mechanism to maintain an optimal water temperature for maximum fuel efficiency. A pumped recirculating water system is also described for cooling the portion of the combustion chamber not submerged in the snow melting medium.

U.S. Pat. No. 5,235,762 (Brady) discloses a snow melting apparatus including a reduction chamber into which heated air is forced by a burner. Heated water is also distributed within the reduction chamber by using a pump and perforated pipes. The burner is controlled by a thermostat to keep the temperature of the water consistent. The cross-section of the reduction chamber is substantially "V" shaped in order to urge material into the container.

U.S. Pat. No. 4,353,176 (Hess) discloses a snow removal apparatus that includes a "V" shaped container. Inside the container is a mechanism for injecting the snow and ice as well as a heating assembly disposed in a storage portion of the container. The heating assembly comprises pipes with a gas that is heated by a gas burner.

International Application No. PCT/US2005/027939 (Rumbaugh) discloses a snow melting apparatus that has a hopper with at least one heater/blower units coupled to a plurality of commingled heat radiant conduits for contact with snow, ice and water, and manifolds connected to the conduits for additional heat exchange and to direct heated air onto snow in the hopper. Terminal sections of the conduits are elevated to an upper region of the hopper and have downwardly directed exhaust ports for substantial and efficient preheating of new snow loads.

U.S. Pat. No. 6,305,105 (Lowman) discloses a device for disposing of snow deposited on a surface, eg. roadways, sidewalks, etc. The apparatus includes a mechanism that removes snow from the surface and guides it into a snow melting apparatus comprising three chambers. Within the first chamber, heated, pressurized water is sprayed onto the snow to aid in the melting process. The second chamber has an agitating device that moves and separates the snow/water mixture into a slurry to melt it. The third chamber, or tank, is connected to the second chamber and stores the melted snow. The system further includes a screen to prevent stones or other debris from entering the heat chamber.

U.S. Pat. No. 5,791,335 (Luciani) discloses a snow melting apparatus comprising a hopper which forms a lower trough, a pivoting ram/screen assembly to prevent large debris from passing to the trough, and a manifold having a plurality of rotating sprinkler heads for discharging heated water onto the snow and debris introduced into the hopper.

United States Patent Application Publication No. 2004/0074114 and Canadian Patent Application No. 2,450,796 (both to Rogers) describe a snow removal system comprising a container having a storage chamber adapted to store snow and a predetermined amount of water, and a heating assembly which is at least partially disposed in the storage chamber. The heating assembly is adapted to heat water stored in the storage chamber to a selected temperature. The system also includes a mixing system adapted to pressurize water and discharge the pressurized water onto the snow. Debris can be evacuated using a door disposed on a wall of the storage chamber.

Canadian Patent No. 769,461 (Petlak) describes a snow melting machine having manifold ducts and pipes placed in parallel to evenly distribute hot gases in a melting chamber. Hot gases are expelled in a downward direction below the water level in the tank toward the bottom of the chamber. The apparatus thus requires the tank to be filled with water prior to initiating the melting process.

Canadian Patent No. 907,989 (Coslowsky) discloses an automatic snow melter comprising a melting chamber mounted on a truck, a rotary agitator for agitating the snow and means for separating debris and rocks. In the melting chamber, the snow is passed under gas jets which quickly melt the snow to fill the chamber with water.

Canadian Patent No. 741,959 (Gontcharuk) discloses a snow disposal apparatus comprising a rotatable heating chamber for continuously mixing snow and water, and burners that allow for hot air to be blown into a tube which is horizontally fixed under the snow.

Canadian Patent No. 712,840 (Glaser et al) describes a snow melting apparatus which uses hot combustion gases to preheat water in a melting chamber. When the water of the melting chamber reaches a certain temperature, snow or ice is added to the chamber for melting.

Some common problems of such prior art devices include the following; debris mixed in with the snow is not sufficiently separated and collected at the bottom of the melting tank, many of the devices utilize more than one burner assembly making the apparatus large and cumbersome as well as requiring vast amounts of fuel lowering efficiency and the devices generally create a substantial amount of noise.

SUMMARY OF THE INVENTION

It is therefore an object of the present invention to provide a single burner snow melting apparatus capable of a snow start which addresses the aforementioned drawbacks of prior art devices.

In accordance with an aspect of the present invention, there is provided a snow melting apparatus capable of a snow start including a receptacle for receiving snow, a single burner assembly mounted in operable arrangement with the receptacle, and an engine room, the single burner assembly having a combustion chamber with a first portion and a second portion shaped and dimensioned for disposition into the receptacle, the combustion chamber having a plurality of directional discharge means formed at least on the second portion for efficient agitation and melting of snow and for prevention of accumulation of debris on sidewalls of the receptacle.

A burner assembly for use in a snow melting apparatus in accordance with the present invention includes a fuel burner having adjustable combustion output and including a nozzle to facilitate the emergence of products of combustion, a combustion chamber having a first portion in substantially airtight communication with the fuel burner and enclosing the nozzle, and a second portion shaped and dimensioned for disposition into a snow melting receptacle or pit, the combustion chamber having a plurality of directional discharge means formed at least on the second portion thereof to permit the egress of products of combustion from the fuel burner and to prevent the accumulation of debris on the sidewalls of the receptacle or pit, and thereby permit agitation and melting of snow loaded therein, and an air cooling assembly for supplying air to cool at least the first portion of the combustion chamber.

The air cooling assembly typically comprises an air supply tube for supplying air from an air supply means to an air injection manifold, the manifold being formed around the combustion chamber and having holes facilitating the emergence of air to cool the combustion chamber. The air supply means may be any device commonly used to supply air, although it is advantageously a device commonly used in conjunction with snow melters. In preferred embodiments of the invention the air supply means is a blower, and particularly, a combustion air blower. The combustion air blower may utilize any type of available fuel, eg. diesel, unleaded.

In the burner assembly of the invention, the combustion chamber will generally include a downcomer tube as the aforesaid first portion, and a sparger tube as the aforesaid second portion. The first, or upper end of the downcomer tube can be fastened to the burner such that the downcomer tube encloses the fuel burner nozzle, and the second, or lower end can be fastened to the sparger tube in substantially perpendicular orientation therewith.

The burner assembly will typically further comprise a housing, or weir, which surrounds at least part of the downcomer tube and which is displaced radially outwardly therefrom. By virtue of this arrangement, the housing defines a space between the exterior of the downcomer tube and the interior of the housing. One or more openings are provided, typically at the lower end of the housing to permit air from the manifold and/or water from the rising water level to enter the space and cool the downcomer tube.

The burner assembly may also have a jacket arranged around the first portion of the combustion chamber, advantageously proximal to the fuel burner. The jacket is shaped and dimensioned to receive a flow of water for cooling the first portion of the combustion chamber, or downcomer tube.

In the burner assembly of the present invention, the directional discharge means may be positioned in any arrangement which gives efficient distribution of the combustion gases. However, it is particularly advantageous for the directional discharge means to be formed on an upper surface of the second portion of the combustion chamber, or sparger tube, and along substantially the entire length thereof and are substantially directed upward and outward therefrom.

In the burner assembly of the present invention, the directional discharge means are preferably short tubes affixed to the sparger tube and particularly preferable that the directional discharge means are flexible and/or directable nozzles allowing for more efficient distribution of the combustion gases.

As another aspect of the present invention, there is provided a snow melting apparatus comprising a receptacle for receiving snow, a burner assembly as defined herein, mounted in operable arrangement with the receptacle, at least one air supply means to supply air to the air cooling assembly and combustion chamber of the burner assembly via a pipe, an engine room to house the air supply means, a fuel tank to provide the burner assembly with fuel, and a controller for controlling the combustion output of the fuel burner of the burner assembly.

In the snow melting apparatus of the present invention, the receptacle for receiving snow is preferably shaped such that an upper portion of the melting tank consists of vertical walls and the lower portion of the melting tank is substantially trapezoidally shaped with the narrower section directed towards the bottom of the melting tank and both the front and rear ends being vertical walls for the entire height of the melting tank.

In the snow melting apparatus of the present invention, the engine room is preferably a walled enclosure and it is particularly preferable that the walled enclosure has a removable roof.

In the snow melting apparatus of the present invention, the air supply pipe is preferably positioned substantially inside the engine room.

In the snow melting apparatus of the present invention, the air supply means is preferably situated inside the engine.

In the snow melting apparatus of the present invention, the fuel tank may be a double walled fuel tank and it is particularly preferable that the inner shell of the double walled fuel tank is made of 304 stainless steel.

In the snow melting apparatus of the present invention, the controller preferably comprises a Programmable Logic Controller (PLC) operably linked to the fuel burners of the burner assembly. The PLC may also be operably linked to the air supply means, so as to control the output thereof. Most preferably, the PLC will be adapted to monitor metal temperatures on the burner assembly, and will operate the burner thereof such that preset metal temperatures will not be exceeded.

As another aspect of the present invention, there is provided a snow melting apparatus further comprising a closed circuit natural cooling system for the burner assembly.

BRIEF DESCRIPTION OF THE DRAWINGS

Preferred embodiments of the present invention will be further described, by way of example, with reference to the accompanying drawings, in which.

DETAILED DESCRIPTION OF THE INVENTION

Figure 1A:
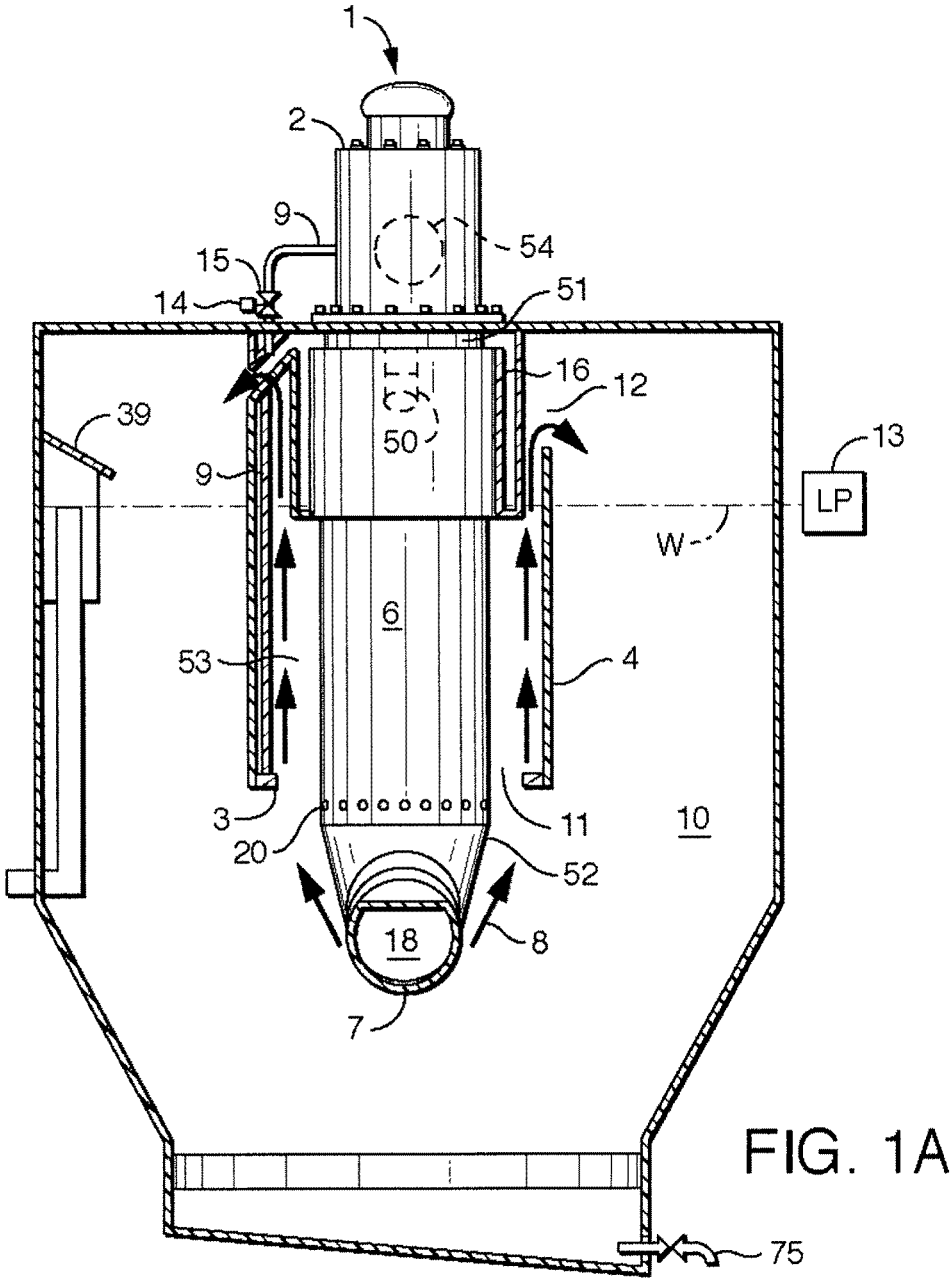
FIGS. 1*a* and 1*b* are schematic sectional views of an example of a single-burner snow melter incorporating the burner assembly and the air injection manifold, respectively, in accordance with an embodiment of the present invention.

Snow melters used in snow removal typically incorporate more than one fuel burner to generate the heat required for melting collected snow. Such multiple fuel burner devices are in general bulky and cumbersome to use and transport, and substantially use more fuel than is needed for certain snow melting applications. The present invention overcomes these difficulties by providing a snow melter capable of a 'snow start' with a single burner assembly allowing for a smaller, more compact device which as a result of the single burner assembly utilizes less fuel.

The burner assembly (1) incorporates combustion chamber (6,7) comprising a downcomer tube (6) and a sparger tube (7). The downcomer tube (6) is affixed at the upper, or first end (51) thereof to a burner (2), and encloses a burner nozzle (50) of burner (2). The lower, or second end (52) of the downcomer tube (6) is joined to the sparger tube (7) in a substantially 90° orientation thereto. The sparger tube (7) has a series of directional discharge means (8), eg. short tubes or nozzles, attached thereon, and extends outward, substantially horizontally, from the lower end (52) of the downcomer tube (6). During operation, products of combustion from the burner (2) are forced downwardly from the nozzle (50) through the downcomer tube (6), typically by the force of air from a blower (not shown) connected to the burner assembly (1) by a blower pipe (54), and exits the burner assembly (1) via the directional discharge means (8) on the sparger tube (7) and through gas injection holes (20) formed in the downcomer tube (6). The gas injection holes (20) are drilled into the downcomer tube (6) in an annular arrangement about the downcomer, and are advantageously positioned above the 90° bend and below the lower level of a housing, or weir (4), which is described in greater detail below. The directional discharge means (8) are positioned and sized to suit the flow conditions of the burner assembly (1), and may be positioned variably around the sparger tube (7) as appropriate for the particular snow melting device. In particularly preferred embodiments, however, the directional discharge means (8) are positioned on the upper portion of the sparger tube (7) and are substantially directed upward and outward therefrom. By directing the warm air/products of combustion from the directional discharge means (8) in an upward and outward direction, agitation of the snow, initially, and subsequently the meltwater accumulating in a receptacle, or tank (10), is increased, thus improving the efficiency of the snow melter. Another advantage of directing the warm air/products of combustion from the directional discharge means (8) in an upward and outward direction, accumulation of debris on the sidewalls of the snow melting receptacle, or tank (10) can be prevented. To remove any sediment that enters the sparger tube (7), a clean out door (18) may be provided at the end thereof.

The melting receptacle or tank (10) may be of any type known in the art. However, in a preferred embodiment of the present invention an upper portion of the melting tank consists of vertical walls and the lower portion of the melting tank being substantially trapezoidally shaped with the narrower section directed towards the bottom of the melting tank and both the front and rear ends being vertical walls for the entire height of the melting tank. This particular tank shape improves water circulation in the melting tank body and promotes sediment separation and collection in the melting tank bottom.

To initiate the snow melting process, snow is loaded into the snow melting tank (10) and the burner (2) of burner assembly (1) is ignited. The products of combustion and heated air are forced through the directional discharge means (8) in the sparger tube (7) and come into direct contact with the snow, causing the snow to melt. The operator loads more snow as required to maintain the tank (10) full of snow. The meltwater starts collecting on the tank bottom and the water level increases.

In order to prevent overheating of the downcomer tube (6) prior to it being cooled by the rising water level, the fuel input to burner (2) is controlled by a Programmable Logic Controller (PLC), such that the metal temperature of the downcomer tube (6) is maintained within an acceptable range. This also minimizes fuel waste resulting from undesired overheating of the downcomer tube (6). The firing rate may vary, depending upon the size of the burner, the fuel mixture, and the particular application for the snow melting device. Typical firing rates will be known to the skilled snow melter operator, and can be optimized based on the aforementioned parameters. Firing rates for the particular snow melting application may be easily entered using the PLC interface. High and low firing rates may be determined based on a timer during the start up period.

Programmable Logic Controllers are commonly known in the art, and are not specific to the invention. Thus, it will be known to one skilled in the art how to integrate and operate such a device together with the burner assembly described herein.

Figure 1B:
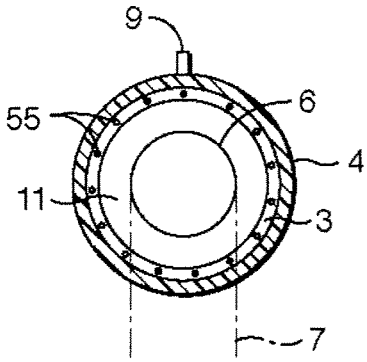
Figure 2:
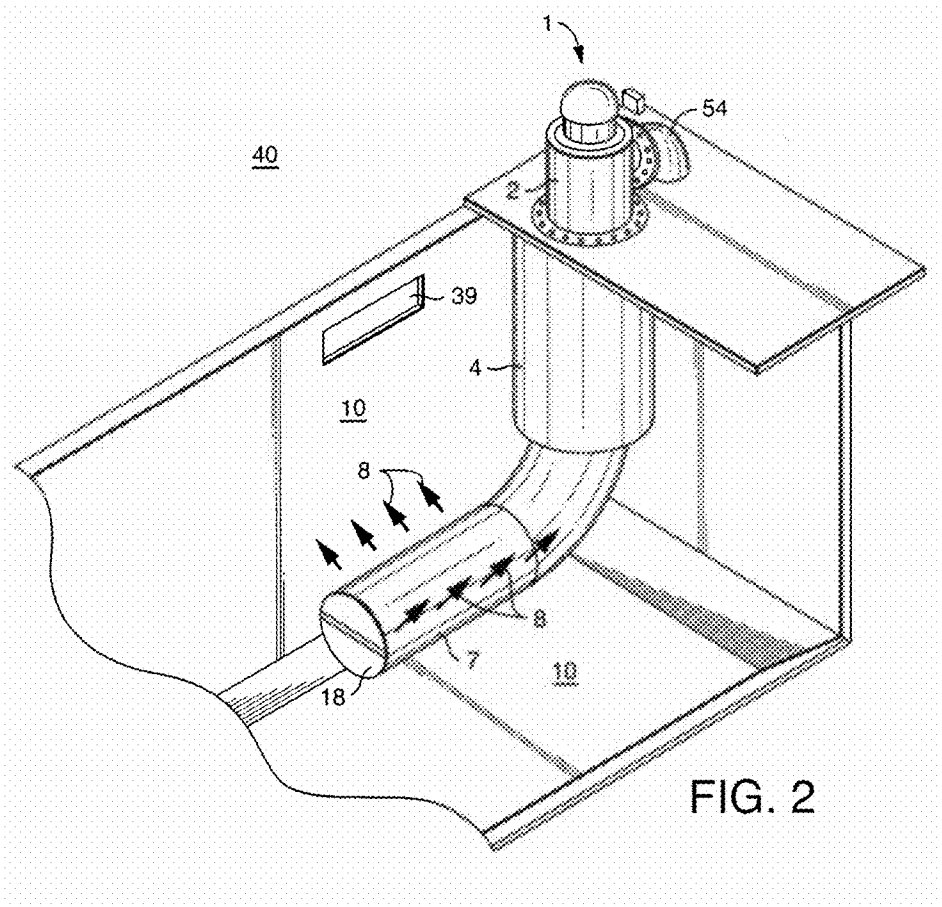
FIG. 2 is a top perspective view of an example of a singe-burner snow melter incorporating the burner assembly of the present invention.
Figure 3:
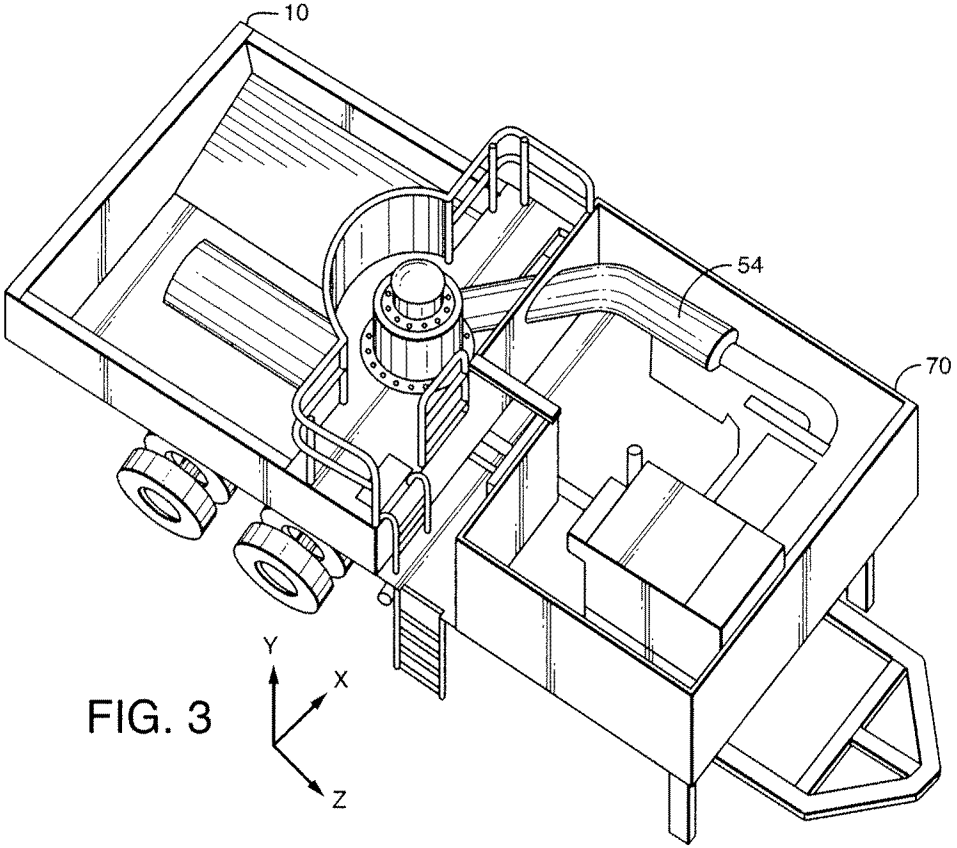
FIG. 3 is a top perspective view of the single-burner snow melter depicted in FIG. 2, illustrating the inside of the engine room.
Figure 4:
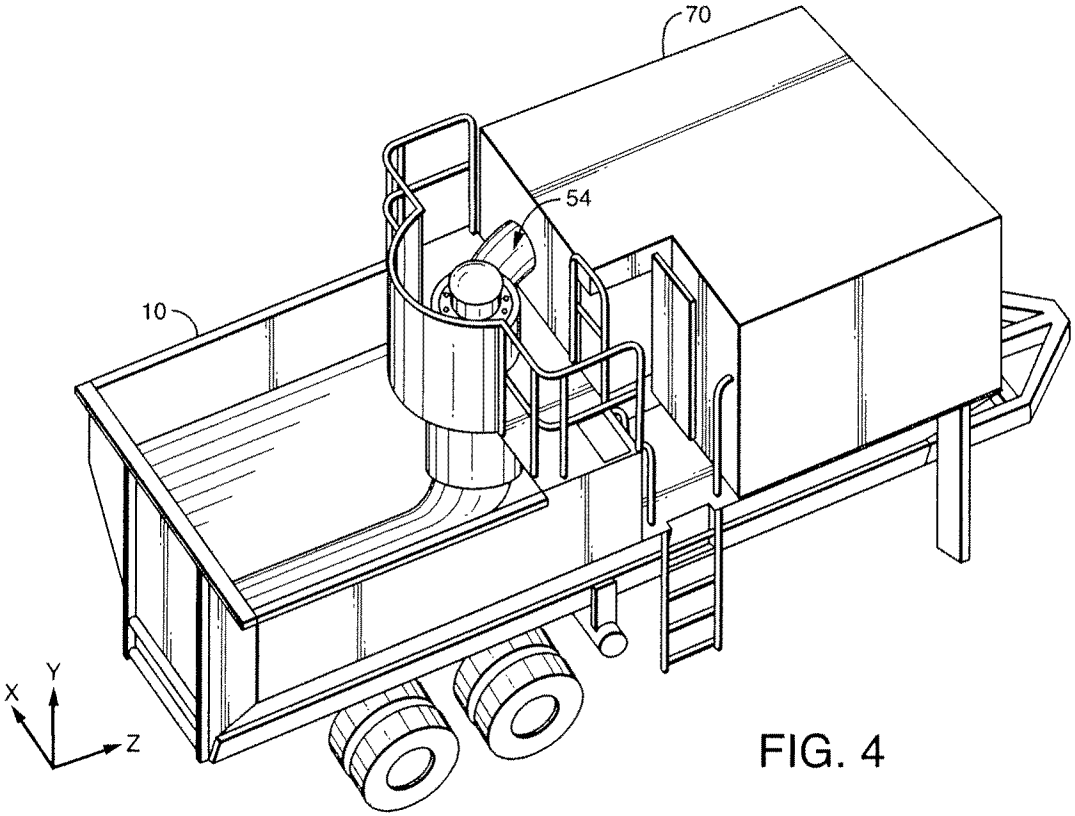
FIG. 4 is a top perspective view of the single-burner snow melter depicted in FIG. 2 illustrating an embodiment of the complete snow melter.

Cooling of the downcomer tube (6) during the initiation process is provided by means of an air injection manifold (3), which is illustrated in greater detail in FIG. 1*b*. The manifold (3), which forms part of an air cooling assembly (3,9), forms an annular ring around the downcomer tube (6), typically around the lower end (52) thereof, and introduces cooling air supplied by the blower via air pipe (9), into the space (53) between the exterior of the downcomer tube (6) and the interior of the housing, or weir (4). Weir (4) envelops a substantial portion of the downcomer tube (6), and has openings (11,12) at the lower and upper regions thereof. A valve actuator (14) is advantageously provided, under control of the PLC, to adjust valve (15), which is positioned in pipe (9) to control the flow of air from blower pipe (54) to the air injection manifold (3). The air injection manifold may be provided in a variety of forms, although it is typically connected to the weir (4), eg. by welding, at the lower end thereof such that holes, or exit ports (55) in the manifold direct air upwards into space (53).

The blower pipe (54) is substantially situated in an enclosed engine room (70). The engine room (70) allows for the preheating of the combustion air and fuel using the radiant heat from the engine, thus increasing efficiency of the burner assembly (2). In a preferred embodiment of the present invention the enclosed engine room (70) is thermally insulated. Another advantage of the enclosed engine room is that it acts as a noise barrier thus reducing outside noise levels of the snow melter device. An air-intake means (not shown), eg. a valve or a screen, is provided for the engine room (70), in a preferred embodiment of the present invention the air-intake means is substantially located at the underside towards the front of the engine room (70), this placement of the air-intake means provides the advantage of minimizing moisture intake and noise emission of the engine room (70).

A fuel tank (not shown) is provided to supply the burner assembly (2) with fuel. In a preferred embodiment of the present invention the fuel tank may be a double walled fuel tank. In a particularly preferred embodiment the inner shell of the double walled fuel tank is made of 304 stainless steel to prevent corrosion that can occur on carbon steel tanks. The engine room (70) floor may form part of the fuel tank top, acting as a fuel storage warmer to keep the fuel tank above freezing. In a preferred embodiment of the present invention heat pipes may be used to cool the engine room and heat the fuel. In a particularly preferred embodiment a heat exchanger using engine coolant may be used as a means to transfer the heat.

A removable roof (71) may be provided for the engine room (70) to facilitate maintenance access, in a preferred embodiment of the present invention the removable roof is a fibreglass roof.

Upon melting of the snow, the water level rises in the tank and enters weir (4) via lower weir opening (11). This provides further cooling to the downcomer tube (6), and results in heating of the water via direct heat transfer. The heated water within the weir (4) is forced upward (as represented by the arrows shown in FIG. 1*a*) due to the upward movement of air from the air injection manifold (3), and exits back into the tank (10) through upper weir opening (12) to mix with and further warm the accumulated snow/meltwater in the tank (10).

When the melting tank water level rises to the minimum water level necessary for normal operation (depicted by W in FIG. 1*a*), as detected by a level probe (13), the PLC program increases the input to burner (2) causing continuous firing at the maximum set rate. Temperatures are measured at various points in the tank and the burner is shut down for cooling when necessary, ie., to maintain the metal temperature within an optimal melting range. The temperature of the meltwater in the tank may range from slightly above freezing temperature, typically 32 F for water although this may vary depending upon salt content, to approximately 100 F. An optimal temperature for snow melting using the apparatus described in FIG. 1*a* is approximately 38 F.

In order to prevent overheating at high firing rates, a cooling jacket (16) may be arranged around the non-submerged upper portion of the downcomer tube (6) of burner assembly (1). This is typically necessary since the upper portion of the downcomer tube (6) is not cooled by water spray from the weir (4). Water may be supplied to the jacket (16) by an air-lift water ejector (not shown). The water air-lift ejector takes a bleed from the combustion air fan and ducts it into an eductor whereby water is induced to flow upwards into the cooling jacket. It is to be understood that cooling jacket (16) is not required for the snow start operation, but is preferably included in the burner assembly (1) to facilitate cooling during mid- to high burner output.

In cases where the snow is especially contaminated, eg. municipal facilities, it may be desirable to provide a closed circuit natural cooling system for the burner assembly (2). Water heated by the cooling of the burner downcomer tube (6) rises from the cooling jacket (16) into a head tank (not shown) situated on the burner platform. From the head tank multiple leads may be taken to cooling surfaces to cool the water, cooling surfaces may include the melting tank sides, or any other outside surface in contact with the cold outside air. After passing through the cooling heat transfer surfaces, the cooled water returns to the bottom of the burner cooling jacket (16). An advantage of a closed circuit system is that the water in it will not be subject to fouling by debris contained in the incoming snow. Other advantages of a closed circuit natural cooling system is that the cooling surfaces may be used to heat the fuel and to prevent ice build up on outside surfaces which may require maintenance during operation, eg. handrails, platform floors and ladder rungs.

The invention may be employed in many different types of snow melters and snow melting applications. For instance, it may be employed in towable, pit or self-propelled snow melters. Such self-propelled snow melters may include an auger and a system of conveyors for collecting snow while advancing along a surface, such as a roadway, and propelling the snow into the melting tank. A bucket loader mounted on the front of a self-propelled snow melter is also envisioned, in which the operator drives into a pile of snow, fills the bucket horizontally, rotates the bucket and raises the bucket up and over the cab, and further rotates the bucket to empty the snow into the snow melting tank. The present invention may also be adapted for use in other snow melting applications.

With the exception of pit-melting applications, an overflow drain is typically required in snow melters of the present invention to maintain the level of water in the snow melting tank. One example of such an overflow drain is depicted in FIG. 1*a* as overflow (39). However, the form of such an overflow drain may vary without departing from the scope of the present invention.

A significant amount of debris may enter the snow melter along with the snow, such as garbage bags and contents, cans, bottles, parking meters, traction sand and grit, and a variety of other objects commonly scattered around roadways. The majority of this debris does not float, and may therefore settle on the bottom of the snow melting tank. Thus, during the snow removal/melting process, debris may build up and influence burner operation to the extent that water flow induced up the weir will decline and burner performance will be inhibited. In order to prevent debris from accumulating in the snow melter, and thus to improve the efficiency of the snow melting apparatus, a debris removal system may be incorporated.

The debris removal system may be any system known in the art. However, a preferred debris removal system for the snow melting apparatus of the present invention includes a hopper situated behind the rear most axle and is fitted between the frame rails, the hopper may be sloped either to the right or left hand side when looking from the rear to the front, at the right hand side (in the case the hopper is sloped to the right hand side) the hopper extends below the frame rails and in the vertical side, a discharge means is provided (75), eg. a valve. The operation to discharge debris consists of opening the valve to allow the discharge of the accumulated debris into a suitable container; this process can be repeated as often as required in between the loading of snow.

The foregoing are exemplary embodiments of the present invention and a person skilled in the art would appreciate that modifications to these embodiments may be made without departing from the scope and essence of the invention described in the claims appended hereto.

What is claimed is:

1. A snow melting apparatus capable of a snow start comprising:

a receptacle for receiving snow, a single burner assembly mounted in operable arrangement with the receptacle, the single burner assembly comprising:

a fuel burner having adjustable combustion output and including a nozzle to facilitate the emergence of products of combustion;

a combustion chamber having a first portion in substantially air-tight communication with the fuel burner and enclosing the nozzle, and a second portion shaped and dimensioned for disposition into the receptacle, the combustion chamber having a plurality of directional discharge means formed at least on the second portion for efficient agitation and melting of snow and for prevention of accumulation of debris on sidewalls of the receptacle a blower pipe connecting a combustion air blower with the first portion of the combustion chamber;

an engine room dimensioned to house at least the combustion air blower and to receive a person, and having an air intake at a front side thereof;

wherein the blower pipe is substantially located within the engine room to facilitate pre-heating of air from the combustion air blower before it arrives at the first portion of the combustion chamber and downwardly forces the products of combustion from the nozzle into the second portion of the combustion chamber.

2. The snow melting apparatus according to claim 1, wherein the receptacle for receiving snow is shaped such that an upper portion of the receptacle consists of vertical walls and the lower portion of the melting tank is substantially trapezoidally shaped with the narrower section directed towards the bottom of the receptacle and both the front and rear ends being vertical walls for the entire height of the receptacle.

3. The snow melting apparatus according to claim 1, wherein the engine room is thermally insulated.

4. The snow melting apparatus according to claim 1, wherein the engine room is a walled enclosure.

5. The snow melting apparatus according to claim 4, wherein the walled enclosure has a removable roof.

6. The snow melting apparatus according to claim 1, further comprising a closed circuit natural cooling system for the burner assembly.

7. The snow melting apparatus according to claim 1, wherein the directional discharge means are formed on an upper surface of the second portion along substantially the entire length thereof and are substantially directed upward and outward therefrom.

8. The snow melting apparatus according to claim 1, wherein the directional discharge means are short tubes.

9. The snow melting apparatus according to claim 1, wherein the directional discharge means are directable nozzles.

10. The snow melting apparatus according to claim 1, wherein a floor of the engine room forms part of a top of a fuel tank for keeping a fuel inside the fuel tank above freezing.

11. The snow melting apparatus according to claim 1 further comprising at least one collecting hopper disposed below the receptacle, said collecting hopper being effective to collect debris which accumulates in the receptacle during operation of the apparatus, said hopper having an inclined hopper bottom and four sidewalls extending substantially upwardly therefrom, wherein an angle between one of the four sidewalls and the inclined bottom is less than 90 deg. and wherein the hopper comprises a means for releasing its contents through a discharge opening disposed in the sidewall which forms an angle less than 90 deg. with the inclined bottom.

12. The snow melting apparatus according to claim 11, wherein the collecting hopper has a grated top and is positioned in the vicinity of a bottom surface of the receptacle.

13. The snow melting apparatus according to claim 11, wherein the snow melting apparatus comprises at least one collecting hopper, said one or plurality of collecting hoppers covering substantially the entire bottom surface of the receptacle.

* * * * *